US008584562B2

(12) United States Patent
Reifenhaeuser

(10) Patent No.: US 8,584,562 B2
(45) Date of Patent: Nov. 19, 2013

(54) METHOD AND DEVICE FOR CUTTING A BONE CONTAINING MATERIAL STRING INTO SLICES

(76) Inventor: Uwe Reifenhaeuser, Flammersfeld (DE)

( * ) Notice: Subject to any disclaimer, the term of this patent is extended or adjusted under 35 U.S.C. 154(b) by 518 days.

(21) Appl. No.: 12/927,416

(22) Filed: Nov. 12, 2010

(65) Prior Publication Data

US 2011/0162496 A1 Jul. 7, 2011

(30) Foreign Application Priority Data

Nov. 12, 2009 (DE) ..... 10 2009 046 646

(51) Int. Cl.
*B26D 7/06* (2006.01)
*B26D 7/32* (2006.01)

(52) U.S. Cl.
USPC ..... 83/23; 83/42; 83/147

(58) Field of Classification Search
USPC ..... 83/42, 111, 206, 222, 153, 282, 396, 83/62, 76.9, 364, 932, 707, 713, 730, 147; 192/143; 452/136, 135, 149–153, 155, 452/156, 167, 170, 187–189, 163
See application file for complete search history.

(56) References Cited

U.S. PATENT DOCUMENTS

| | | | | |
|---|---|---|---|---|
| 2,168,612 | A | 8/1939 | Ahrndt | |
| 2,541,442 | A * | 2/1951 | Skoog | 452/149 |
| 3,162,226 | A | 12/1964 | Toby | |
| 4,572,044 | A * | 2/1986 | Antonissen | 83/42 |
| 5,989,116 | A * | 11/1999 | Johnson et al. | 452/150 |

FOREIGN PATENT DOCUMENTS

| | | | |
|---|---|---|---|
| DE | 21 15 111 | A | 10/1972 |
| DE | 10 2006 062 336 | B3 | 2/2008 |
| DE | 10 2008 026 982 | A1 | 12/2009 |

* cited by examiner

*Primary Examiner* — Ghassem Alie
(74) *Attorney, Agent, or Firm* — Von Rohrscheidt Patents

(57) ABSTRACT

A method and device for cutting a bone containing material string into slices with the steps: feeding the material string through a feed device towards to a cutting device; cutting a slice partially from the material string end through a rotating cutting tool of the cutting device; moving a brake element of a brake device into a conveying cross section located in a feed direction behind a cutting plane before completely cutting the slice; braking a slice after the slice has been completely cut from the remaining material string with respect to a movement of the slice oriented away from the cutting plane through the brake element; moving the brake element out of the conveying cross section after braking the slice and having the braked slice flip onto the conveying device; and placing the cutoff slices successively in a scaled or stacked arrangement onto a conveyor.

12 Claims, 13 Drawing Sheets

METHOD AND DEVICE FOR CUTTING A BONE CONTAINING MATERIAL STRING INTO SLICES

RELATED APPLICATIONS

This patent application claims priority from and incorporates by reference German patent application DE 10 2009 046 646.0, filed on Nov. 12, 2010.

FIELD OF THE INVENTION

The invention relates to a method for cutting a bone containing material string into slices, the method including the following steps:

- feeding the material string through a feed device in a feed direction towards a cutting device;
- successively cutting off slices from an end of the material string through a rotating cutting tool of the cutting device; and
- successively placing the cut off slices onto a conveying device in a partially overlapping or stacked arrangement and conveying them from the cutting device.

The invention furthermore relates to a device for cutting a bone containing material string into slices, wherein the device includes the following features:

- a cutting device including a rotating cutting tool, which defines a cutting plane;
- a feed device, through which the material string is movable towards the cutting device, so that successive slices are cutable from an end of the material string;
- a conveying device on which the cutoff slices are placeable successively in a scaled or stacked arrangement, and through which the slices are conveyable from the cutting device; and
- a brake device with a brake element which is movable from an idle position in which the brake element is disposed outside of a conveying cross section, into a brake position in which the slice cut off from the material string is brakeable in its movement oriented away from the cutting plane, wherein the brake element disposed in the idle position facilitates a flipping of the cutoff and braked slice onto the feed device.

BACKGROUND OF THE INVENTION

Methods and devices for cutting a bone containing material string into slices are well known in the art. Methods or devices for this are being used in particular for cutting pork chops, T-bone steaks or other cutting materials that include bones. A cutting tool of a cutting device can thus be configured as a sickle blade or as a blade with a spiral shaped cutting edge. Due to the sometimes rather massive bones included in the cutting material, devices of this type have to be configured very strong in the portion of the cutting device, this means in particular with respect to the cutting blade and the feed device in a portion of cutting frames disposed in front and also behind the cutting blade in order to be able to receive the rather large cutting forces occurring in particular when cutting bones and the reactive forces resulting there from.

The known devices are typically high performance machines which are operated in large meat packing operations with high cutting frequency and accordingly high volume throughput. Thus typically slices conveyed by the conveying device from the cutting device are subsequently immediately fed to a packaging device and in particular packaged in dish shaped containers with a cover configured as a clear wrapping foil. Packaging units with a plurality of slices are often sold at self service counters of large grocery stores. For esthetic reasons, this means in order to provide a particularly attractive appearance of the of the cutting material cut into slices for a customer, placement of the slices on a conveying device and also the packaging dish is typically performed in a so called scaled, this means fanned, arrangement in which the slices overlap partially. In this case the conveying is performed through a horizontally moving conveyor belt.

Alternatively also a stacked placement of the slices is possible, wherein the placement is thus performed on a placement table which is moveable in downward direction perpendicular to the feed direction in order to provide constant placement conditions for each slice. Providing a geometrically exact placement with a scaled or stacked slice arrangement has proven problematic in practical applications for material strings including bones. This is caused in particular by the fact that the meat (muscle tissue or fat) surrounding the bones physically acts totally different compared to the bone during the cutting process. Due to the hardness and brittleness of the bone, severing the bone is not a typical cutting process, but the bone is rather "chopped". In order to better receive the cutting forces in the cutting frame and in the machine frame when severing the bone and in order to avoid unwanted shape changes of the material string during the cutting process the material string is placed onto the feed device which is typically configured as a conveyor belt, so that the bone is placed as proximal as possible to the surface of the feed device, preferably so that it is directly placed on the feed device. In this case initially the softer meat or fat portions of the material string are cut and subsequently the slice is cut off completely by cutting the bone. In this final cutting process for each slice an undesirable effect occurs due to the brittleness of the bone and the wedge shaped geometry of the portion of the cutting blade adjacent to the cutting edge, in that the slice that has just been cut off performs uncontrollable movements in feed direction. The energy required for cutting and introduced by the cutting tool rotating at high speed is namely large enough, so that the cut off slice is provided with an undesirably large impulse which accelerates it away from the blade. Thus, it is particularly disadvantageous when the directions and also the initial velocities of the "escaping" slices vary strongly and are thus not predeterminable. This leads to an uneven and geometrically imprecise placement of the scaled or stacked slices on the conveying device. In an extreme case the deviations of separation velocities and placement positions of the cut off and then 90° flipping slices can be large enough in a scaled placement, so that one slice overtakes a slice cut off previously. Due to the unevenness of the slice placement from a geometrical point of view it is, however, indispensible for the known methods that the slices are manually readjusted or inserted subsequent to placement on the conveying device or during insertion into dish shaped containers of packaging units. This is very labor intensive which in turn increases the expense of processing food strings that include bones.

An alternative generally known cutting method includes not placing the cut off slices on the conveying device in a scaled or stacked arrangement, but conveying them away in a standing arrangement. In this case there is a support device for the first slice of the packet, wherein the support device is disposed above the conveying device and moves along in feed direction. The support device prevents that the first slice flips over and the support device assures a standing conveying of the first slice on the conveyor belt, wherein the subsequently cut off slices successively form a slice packet in this manner. In this case a velocity of the conveying device corresponds to a feed velocity. Alternatively operations can only be performed without a support device in that the first slices flip over and then provide support for the slices cut off subsequently, wherein the slices are thus transported away standing upright.

The standing arrangement of a packet of cut off slices which increases in length continuously prevents that a newly cut off slice can perform an uncontrolled movement away from the blade, however, also for this known method hand finishing is required when a scaled or fanned arrangement of the slices shall be implemented instead of an optically rather unattractive stacked slice arrangement.

BRIEF SUMMARY OF THE INVENTION

It is the object of the invention to provide a method and a device for cutting a materials string that includes bones into slices, wherein the method facilitates a geometrically exactly scaled or stacked arrangement of the cut off slices on a conveying device without requiring manual interference by operators. Based on the method described supra the object is accomplished by the following method steps:

- Before completely separating a slice from a remaining material string, a brake element of a brake device is moved into a conveying cross section located in a feed direction behind a cutting plane of a cutting tool;
- A slice subsequently cut off is braked by the brake element with respect to its movement oriented away from the cutting plane after being completely separated from the remaining material string.
- After braking, the brake element is moved out of the conveying cross section and the braked slice flips onto the conveying device.

The invention is based on the finding that energy introduced into a slice during a last phase of the cut off process, wherein the energy is embodied in a large impulse transferred to the slice, has to be reduced through a brake device including a brake element, before the slice is permitted to perform further movement towards the conveying device. The brake element of the brake device thus acts as a temporary block for the cut off slices which reduces their kinetic energies to a large extent.

According to the invention, however, the brake element does not permanently remain in the conveying cross section of the material string, but performs a back and forth movement, in particular an up and down movement in which the brake element is moved out of the conveying cross section after braking in order not to prevent the flipping movement of the slice which may have already begun or which is about to begin at this point in time.

In principle blocking at least a portion of the conveying cross section through the brake element is problematic, since the braking slows down the movement of the respective slice after being cut off, which is in conflict with the goal of high cutting performance, this means high cutting frequency of the cutting tool. When the brake element is moved with sufficient acceleration and exact timing, the cut off slice is, however, only braked far enough and long enough, so that a controlled flip movement of the cut off slice onto the conveying device is assured. The slice does not have to be brought to a complete stop, it rather suffices when the slice is braked in its lower portion where the bones typically extend. Namely when a slice is only braked in the lower portion while the rest remains un-braked a rotation of the slice is caused which facilitates a flipping of the slice after a short brake- or stop impulse. Depending on the movement of the cut off slice, it can also impact the brake element with a lowered portion of the slice so that the slice is stopped wherein the brake element is then used as a type of stop element.

However, it has been proven that the method according to the invention facilitates very high geometric precision when depositing the cut off slices in a scaled or stacked assembly which does not reduce the cutting performance compared to the known method. The method according to the invention facilitates completely omitting a manual readjustment of the cut off slices in order to achieve an optically appealing continuous slice arrangement.

According to an embodiment of the invention it is provided that the brake element is transferred from an idle position in which it is disposed completely outside of the conveying cross section into a brake or stop position in which it blocks a portion of the conveying cross section which portion faces a contact surface of the material strand, and that the brake element is subsequently transferred into an idle position. Thus, the brake element is moved in a plane during its movement from the idle position into the brake position, wherein the plane is oriented parallel to the cutting plane. This way a particularly quick insertion of the brake element into the conveying cross section and also a quick reopening of the conveying cross section can be achieved after the braking has been performed. Thus the stroke which is covered by the brake element can be 10 mm to 20 mm.

When the brake element is disposed in the brake position, viewed in feed direction, at a distance from a front side oriented towards the brake element of a slice being produced, which slice is still connected to the material string, on the one hand side there is certainty that the movement of the brake element is not impeded by a friction generating contact with the front side of the slice to be produced. Furthermore, a sufficiently large distance between the brake element and a subsequent slice also facilitates a particular variation in the slice thickness which is required for a precise cutting of slices with respect to weight based on variations in the size of the cross sectional surface of the material string. Consequently the distance between the cutting tool and the brake element is always slightly greater than the largest possible slice thickness. For example the distance between the front side of the material string and the brake element can be 3 mm to 5 mm.

From a timing point of view removing the brake element from the feed cross section after the braking has been performed represents the most critical moment in the entire method. Thus, it is particularly important that the brake element is removed from the conveying cross section as quickly as possible after the current slice has been braked in order not to impede the tilting process of the slice and thus possibly degrade the cutting performance. On the other hand after a cut off slice has flipped, typically there is sufficient time available in order to move the brake element back into the braking position again, since the movement can be performed in parallel with cutting the muscle and fat tissue of the material string disposed on above the bone and while a brake effect is not yet required during this phase.

Therefore it is particularly advantageous when a rotating output of the brake device viewed over a movement cycle of the brake element is moved with different angular speeds, wherein the brake element is moved with a greater velocity from the brake position into the idle position than in the opposite direction. The same is also helpful for a linear drive (linear motor) for the brake device, wherein different velocities should then be implemented for the back and forward movement.

The object is achieved through a device with a cutting device including a rotating cutting tool, which defines a cutting plane, a feed device, through which the material string is movable towards the cutting device, so that successive slices are cutable from an end of the material string, and a conveying device on which the cutoff slices are placeable successively in a scaled or stacked arrangement, and through which the slices are conveyable from the cutting device, and including the following features.

A brake device comprising a brake element which is transferable from an idle position in which it is disposed outside of a conveying cross section into a brake position in which a slice cut off from the material string is breakable with respect to its motion oriented away from the cutting plane, wherein the brake element disposed in the idle position facilitates a flipping of a cut off and braked slice onto the conveying device.

Thus, it is particularly advantageous when the brake element is a slide made from sheet metal which is moveable in a linear oscillating manner within a slide plane extending parallel to the cutting plane and preferably having U-shape, wherein two U-shaped arms are moveable on both sides of the conveying cross section between a cutting frame and a respective support element, wherein the conveying cross section is defined by a pass through opening in a cutting frame of the cutting device.

The U-shape facilitates supporting the slides in portions laterally adjacent to the pass through opening and therefore facilitates omitting a support below the pass through opening which reduces the space requirement for the slide support. Therefore the slide can be configured short viewed in an orientation of the U-arms and can be directly connected to coupling or transmission links.

The oscillating movement of the brake element can be generated in a particularly simple manner through a crank drive of the brake device, wherein the brake element is connected to a swing arm and the swing arm is connected with a crank that can be driven in rotation.

In order to minimize installation space for the brake device and in order to provide the shortest paths possible between the resting position and the brake position it is proposed that the brake is disposed element in the idle position below a plane defined by a contact surface of the feed device or of the conveying device.

Eventually it is provided according to the invention that a lower surface of a cutting frame arranged between the brake element disposed in idle position and the cutting plane is beveled, wherein a surface orthogonal of the beveled surface is oriented away from the cutting plane. Thus, a flipping movement of the cut off slices is also facilitated after the braking has been performed and after the brake element has been pulled back from the feed cross section, which in turn facilitates a quick forward conveying of the cut off slices.

BRIEF DESCRIPTION OF THE DRAWINGS

The invention is subsequently described in more detail based on an exemplary embodiment of a food cutting device with reference to drawing figures, wherein.

DETAILED DESCRIPTION

Figure 1:
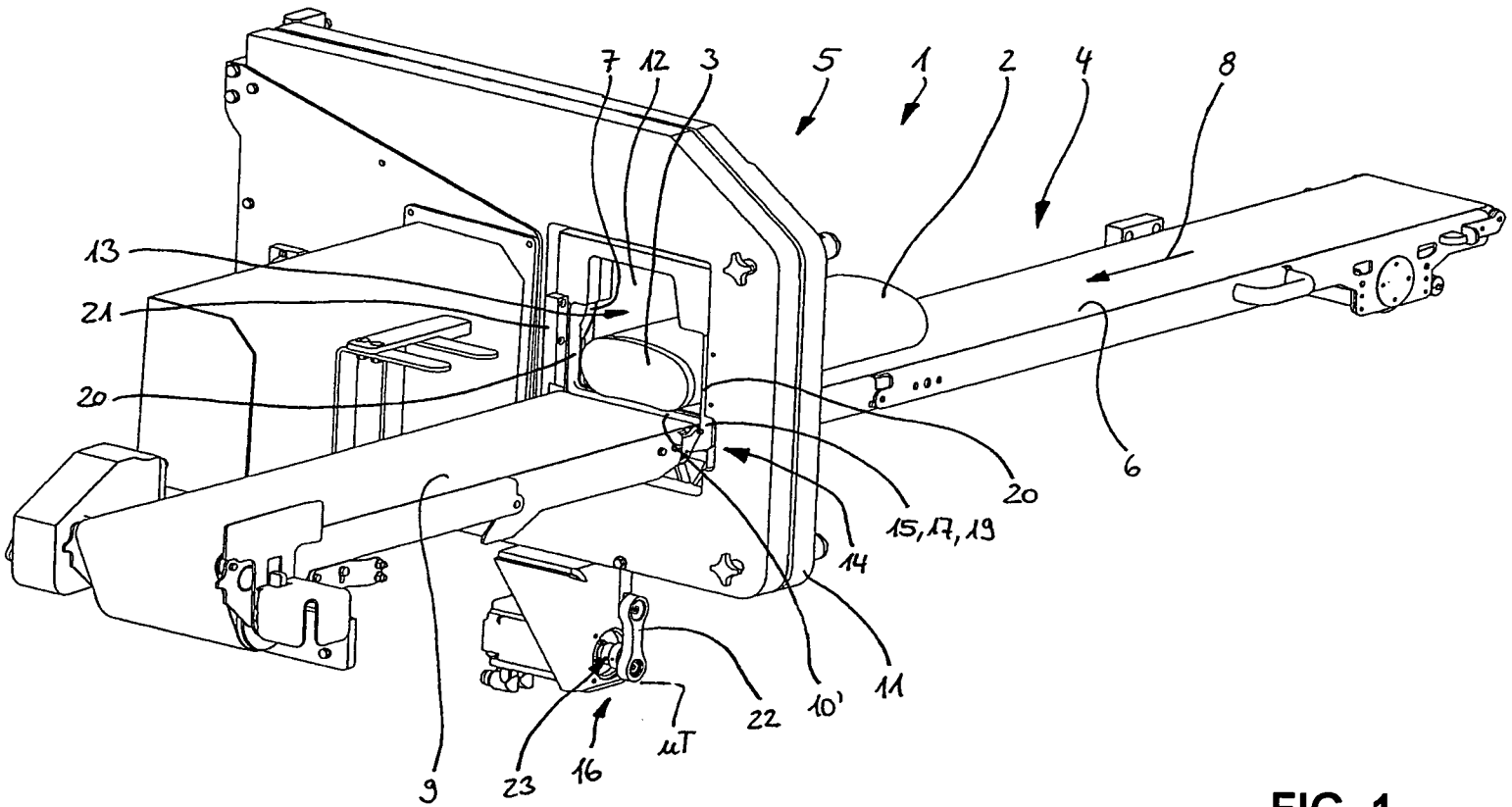
FIGS. 1-7 respectively illustrate a three dimensional view of a device according to the invention with a material string in various positions.

FIGS. 1-7 illustrate a device 1 according to the invention for cutting a bone containing material string 2 into slices 3, wherein the material string 2 is moved forward through a feed device 4 configured as a endless belt in a horizontal direction towards a cutting device 5. The figures illustrate the material string 2 in a simplified manner and without bones. Typically the bones extend in the material string 2 along its lower side, thus on a side of the material string 2 oriented towards a contact surface 6 of the feed device 4.

The cutting device 5 includes a rotating cutting tool 7 which is illustrated in the different figures respectively in a different positions corresponding to a progressive cutting. Thus, a conveying device 9 configured as an endless conveyor belt is disposed in a feed direction 8 behind the cutting device 5, wherein the cut off slices 3 are placed onto the conveying device 9 and conveyed forward by the conveying device 9. The cutting device 5 has two cutting frames 10, 10' which extend parallel to one another and have a width of 15 to 20 mm, wherein the cutting tool 7 is disposed between the cutting frames 10, 10'. The cutting frames 10, 10' and the cutting tool are enveloped by a cutting box 11. The cutting frames 10, 10' respectively include a pass through opening 12 which defines a conveying cross section 13 through which the material string 2 is being conveyed.

Furthermore, the device 1 includes a brake device 14 with a brake element 15 behind the cutting device 5, wherein the brake element 15 can be transferred from an idle position 17 (cf. FIG. 1) to a brake position 18 (cf. FIG. 2) through a crank drive 16. The brake element 15 is configured as a slide 19 which is movable in a linear oscillating manner in a slide plane extending in parallel with the cutting plane formed by the cutting tool 7. The slide 19 has U-shape with two U-arms 20 which extend on both sides of the conveying cross section 13 and which are respectively movable between a cutting frame 10 and a respective support element 21. The brake element 15 is positioned, so that a distance of approximately 3 to 5 mm remains between the brake element 15 and the cutting tool 7 as a function of the slice thickness to be cut. This way, it is assured that the movement of the brake element 15 is not impeded by the material string 2 or by friction between the material string 2 and the brake element 15. Only when a slice 3 skips directly after it being cut off due to the brittleness of the cut bone, the slice contacts the brake element 15 directly and a further movement of the slice is impeded by the brake element, thus stopped.

The crank drive 16 includes a coupling element 22 connected with the brake element 15 and with a crank 23 that is drivable in rotation.

FIG. 1 illustrates the brake element 15 in its resting position 17, in which it is disposed outside of the conveying cross section 13. In this position, the coupling element 22 which is eccentrically attached at the crank 23, is at its bottom dead center.

Though the cutting tool 7 in FIG. 1 protrudes slightly into the conveying cross section 13, however, it does not engage the material string 2 yet. The slice 3 to be cut off during a cutting process is already drawn in FIG. 1 only for the purpose of improved illustration.

Figure 2:
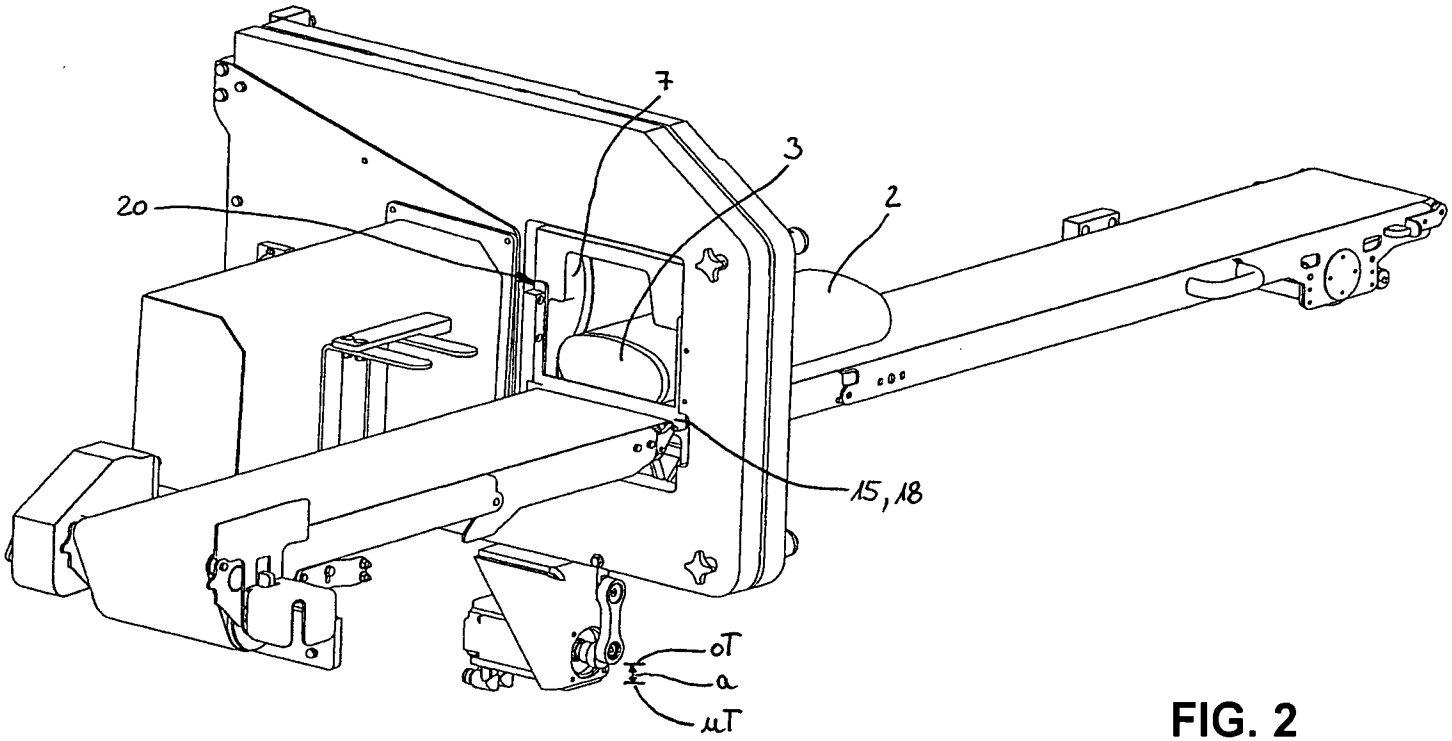
Figure 3:
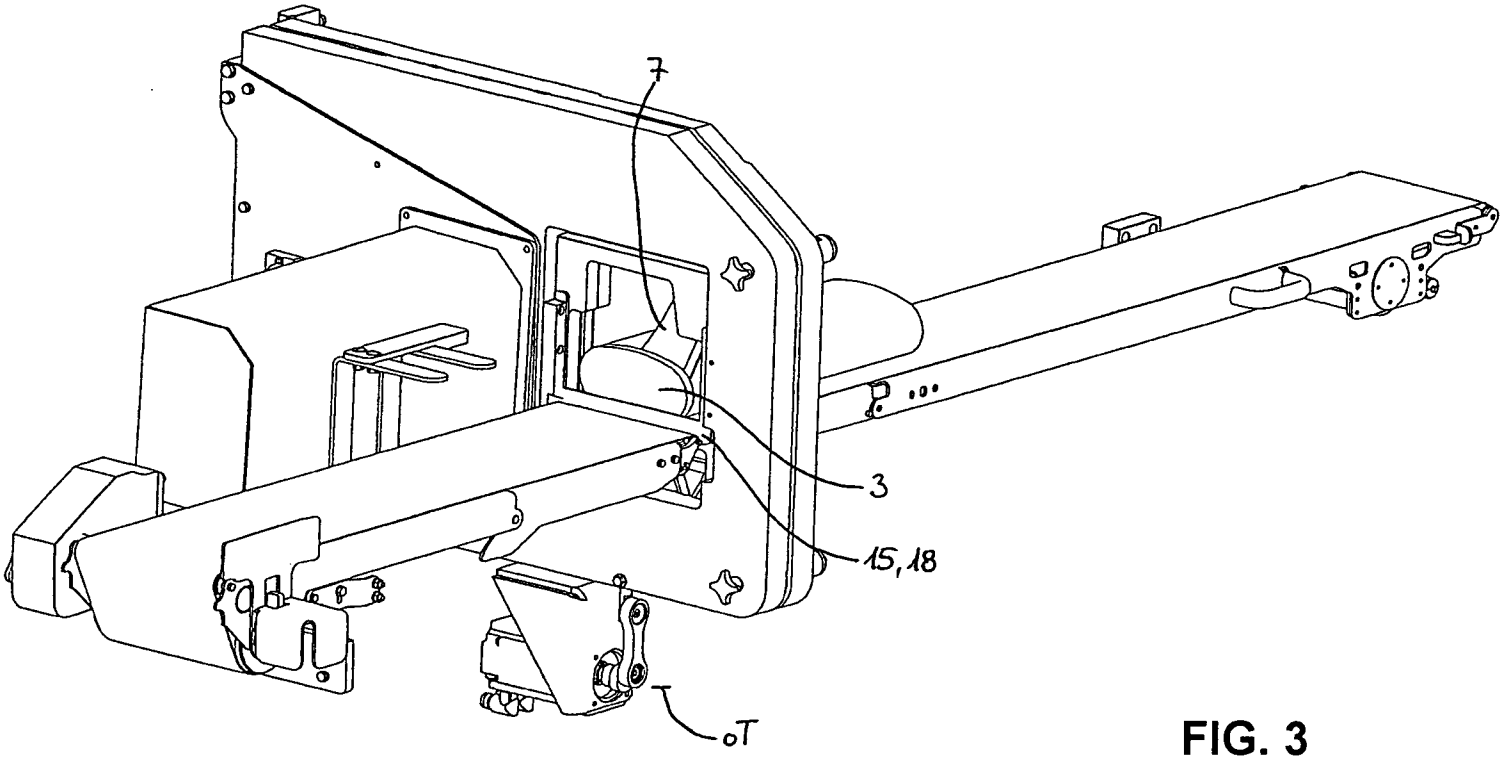

The brake element 15 is in a brake position 18 in FIGS. 2 and 3 and protrudes into the conveying cross section 13, wherein the coupling element 22 has reached its top dead center. The U-arms 20 protrude in this position beyond the support elements 21. The maximum amount by which the brake element 15 can protrude into the feed cross section 13 corresponds to the stroke of the coupling element 22, thus the distance a between the top dead center and the bottom dead center which is preferably between 10 mm and 20 mm.

In FIG. 2, the cutting tool 7 engages the material string 2 and in FIG. 3, the cutting tool 7 has already passed a greater portion of the material string 2 and has almost cut a slice 3 off. Since the brake element 15 is disposed in front of the lower portion of the slice 3, the slice cannot skip substantially in particular when cutting the bone not illustrated in FIG. 2

Figure 4:
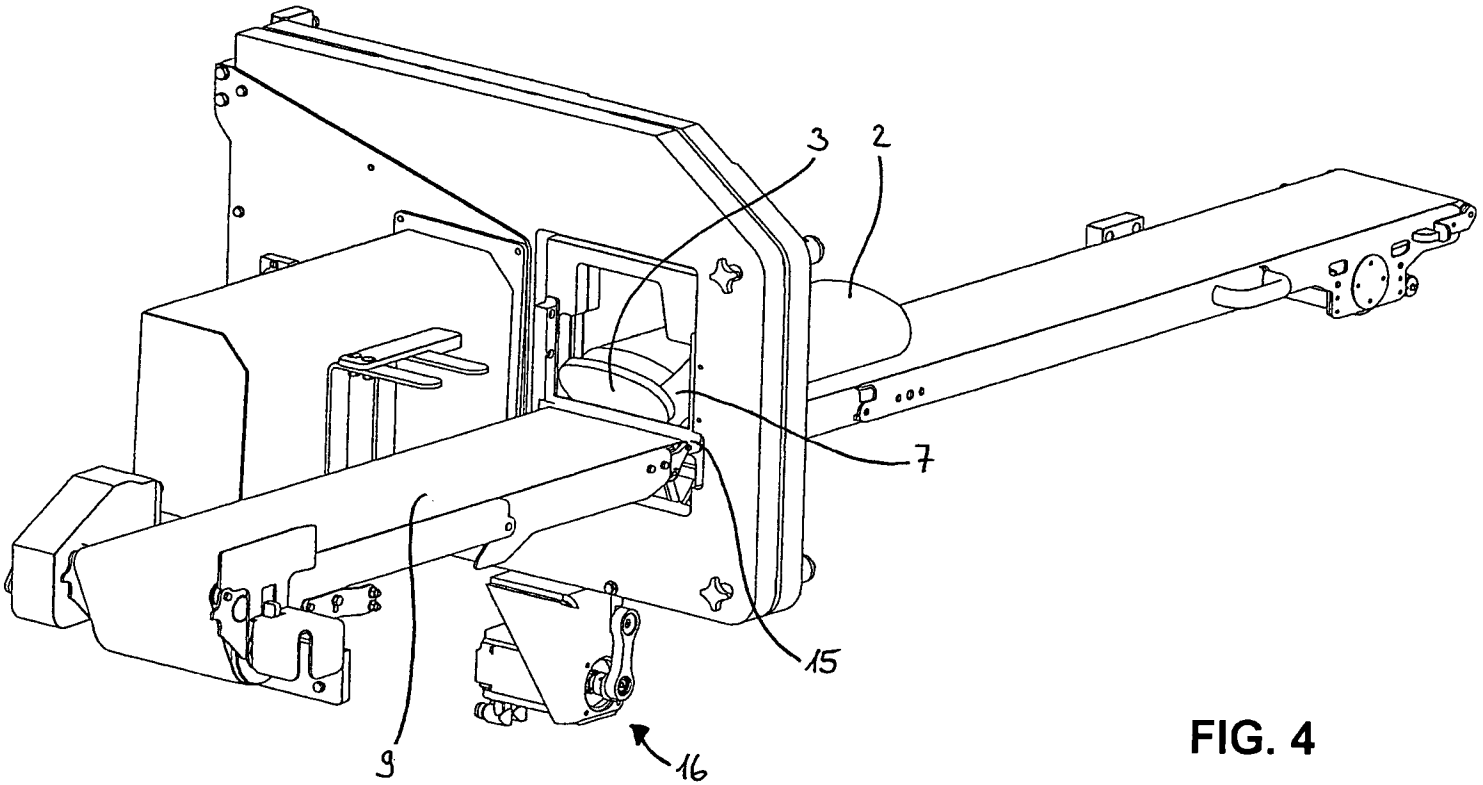
Figure 5:
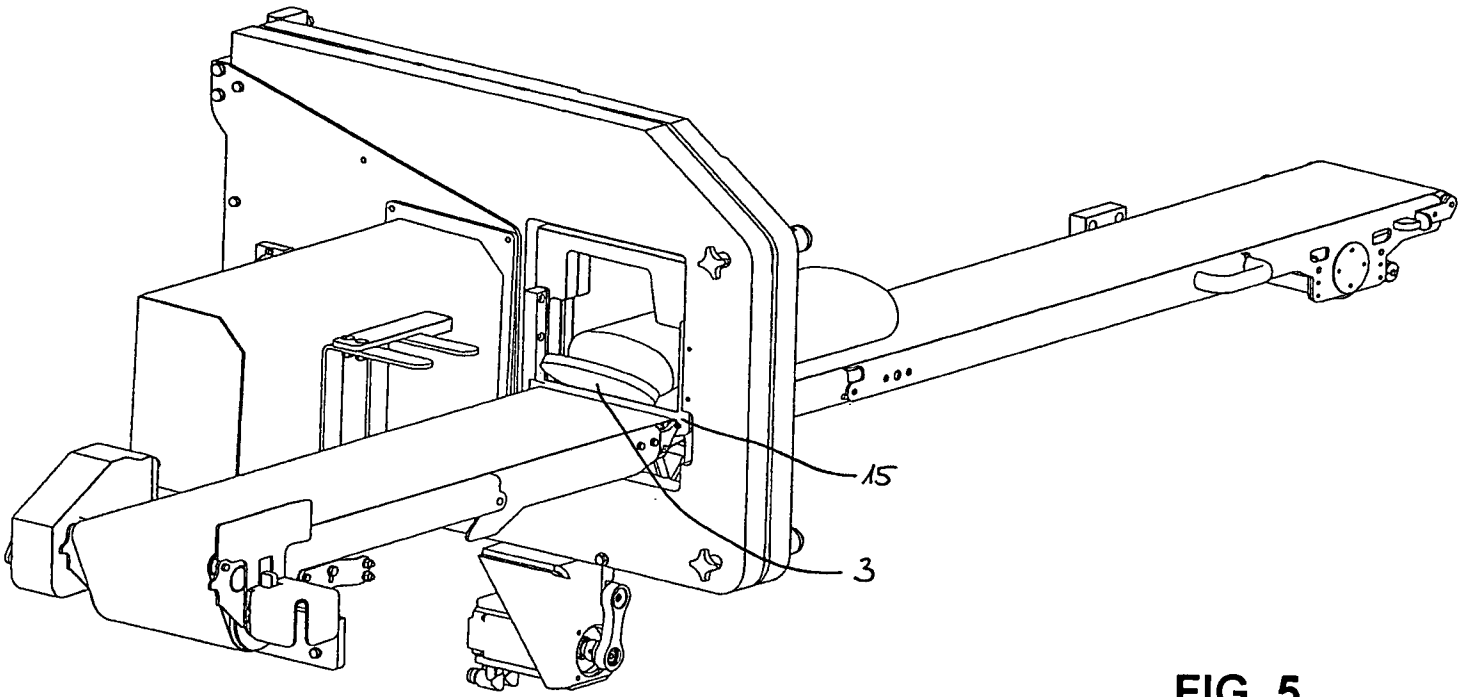
Figure 6:
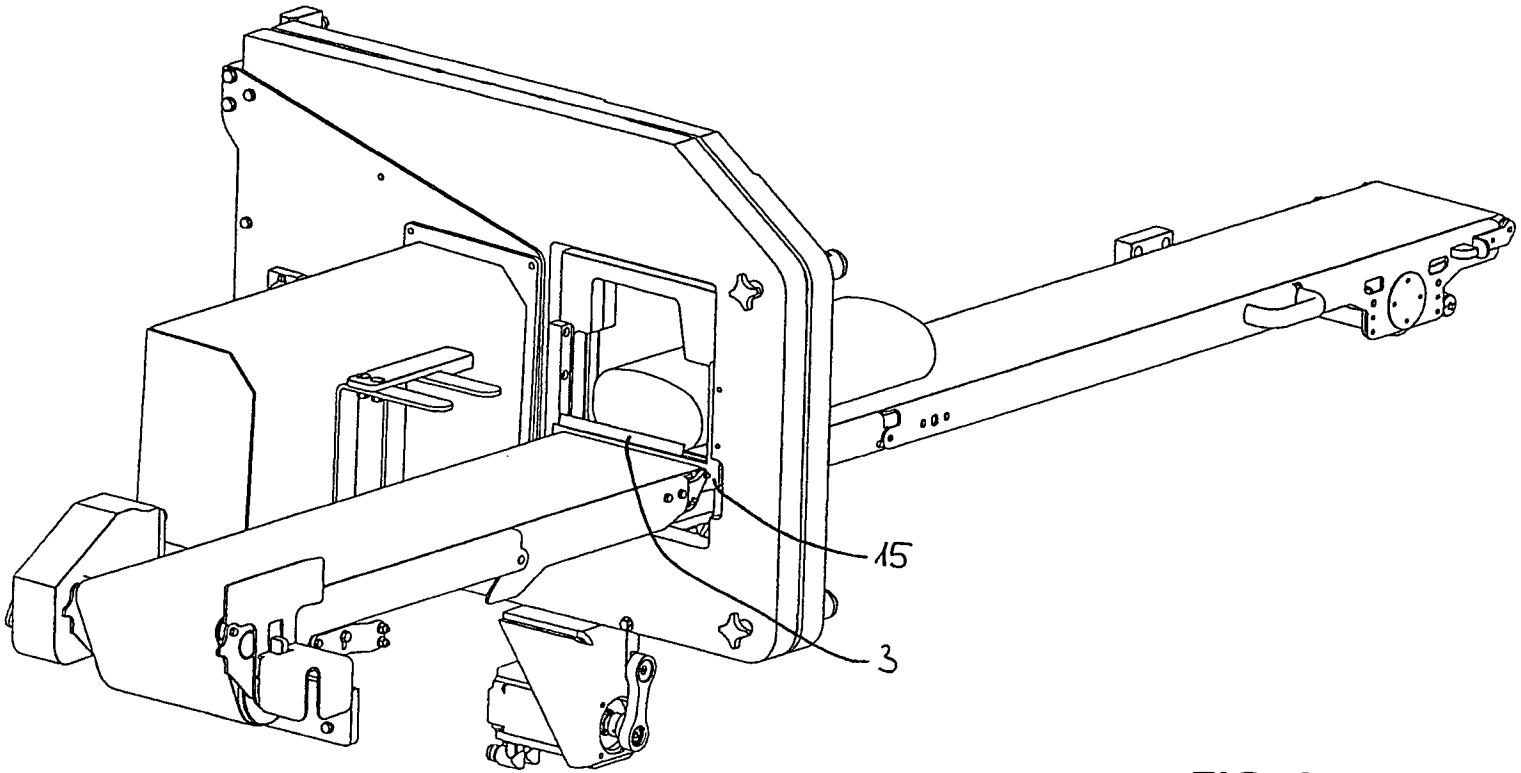

FIG. 4 illustrates a situation where the brake element 15 starts lowering again, wherein the slice 3 is now completely cut off from the end of the material string 2 and starts to flip onto the conveying device 9. The coupling element 22 of the crank drive 16 is thus disposed between its top dead center and its bottom dead center.

Figure 7:
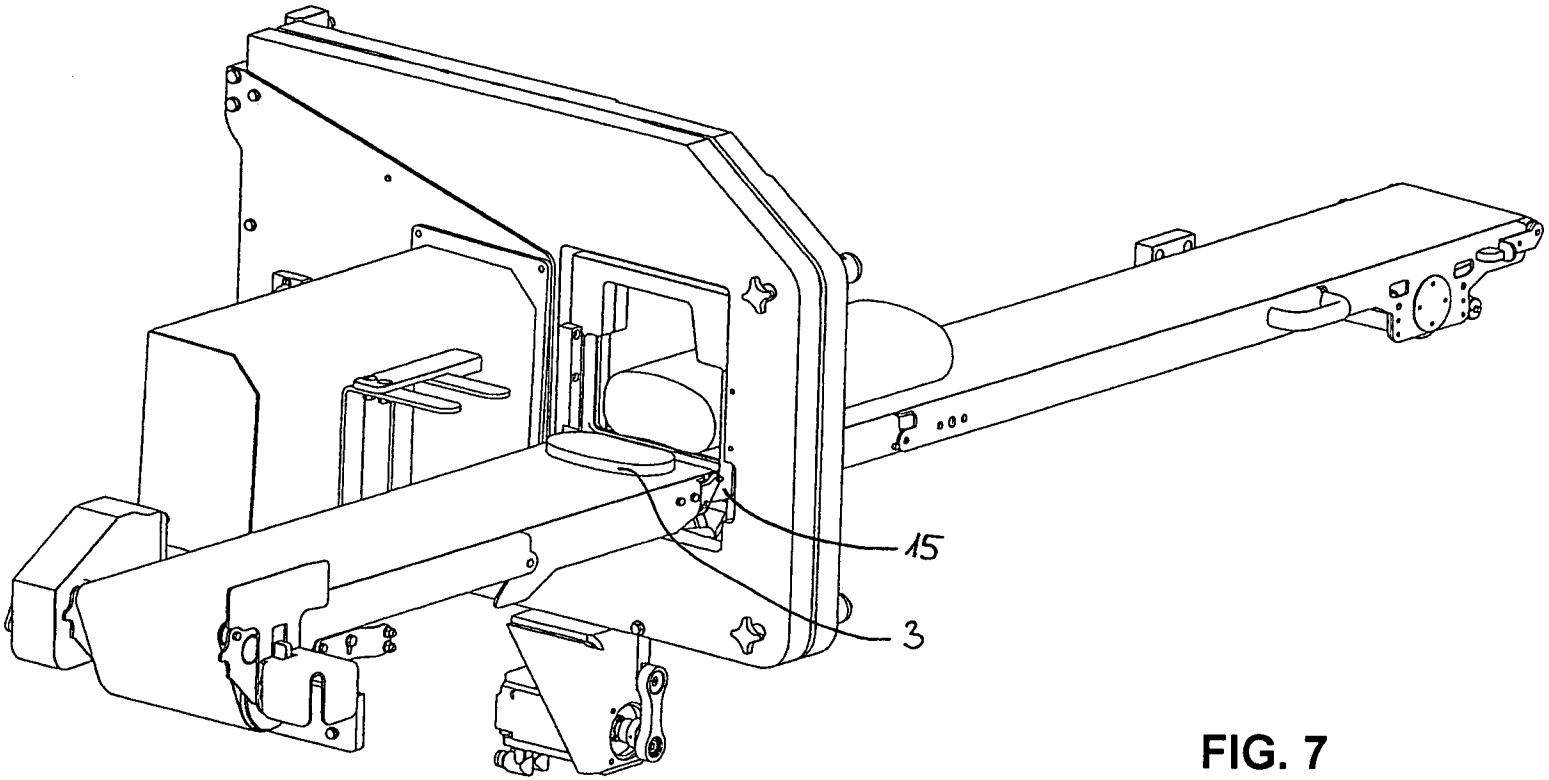
Figure 8:
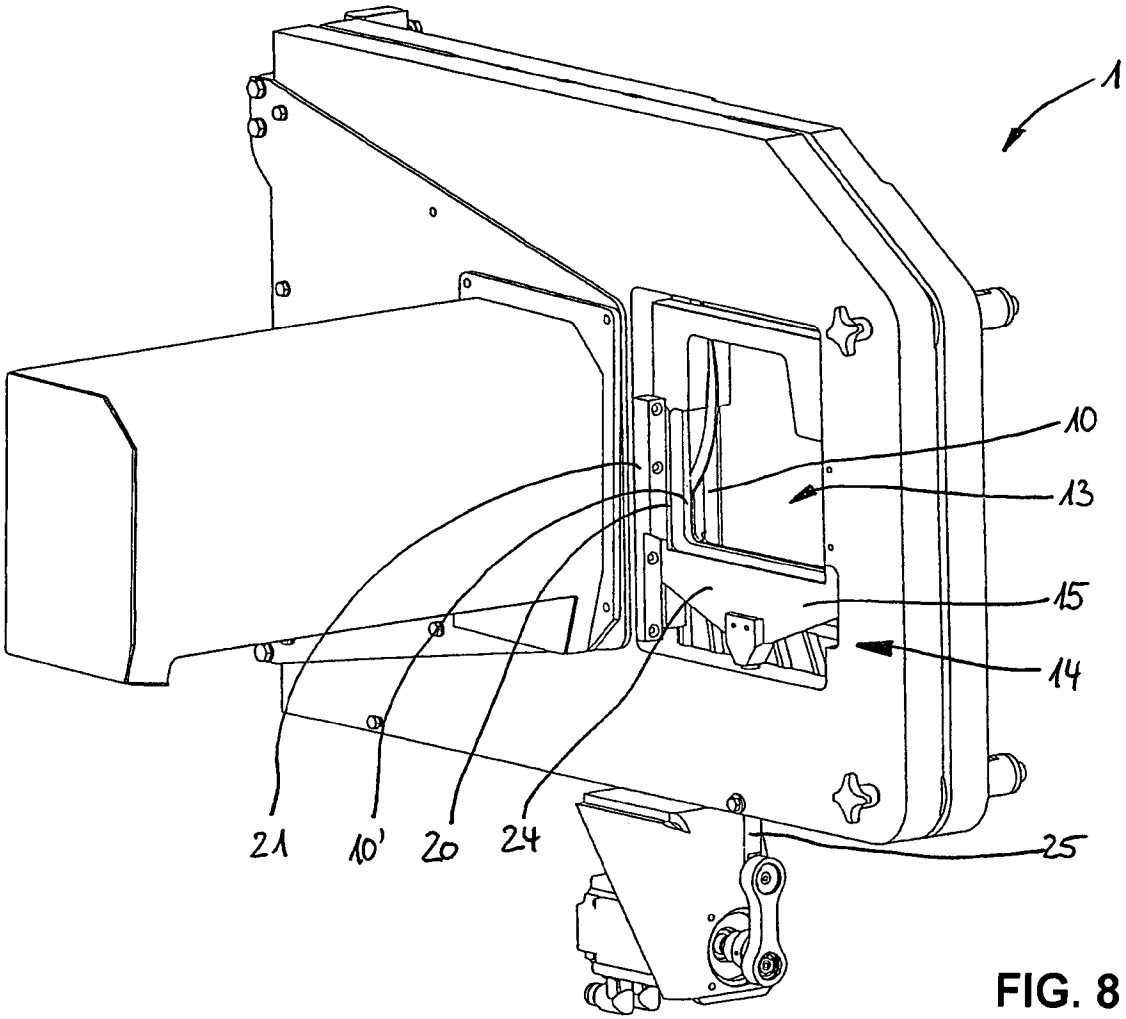
FIGS. 8-13 respectively illustrate a three dimensional view of the device without the material string and the feed- and conveying device.
Figure 9:
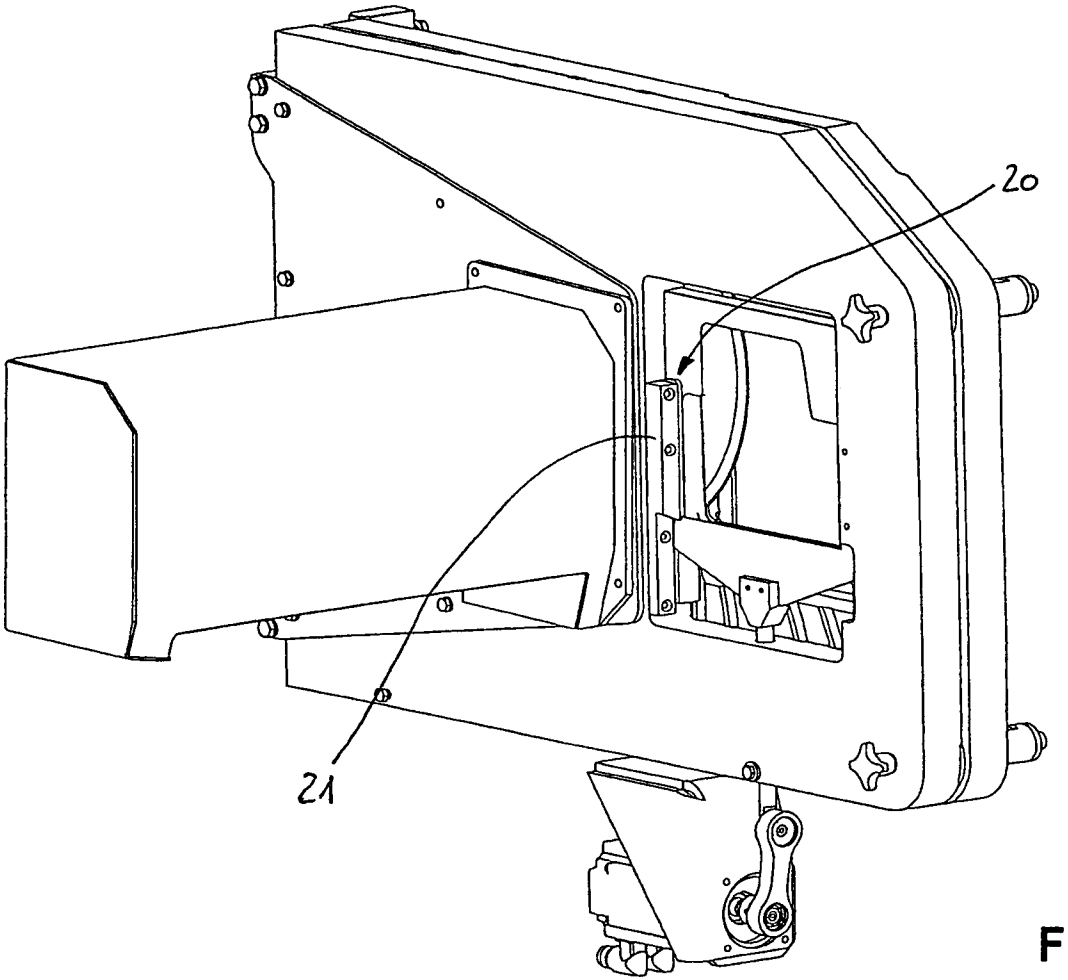
Figure 10:
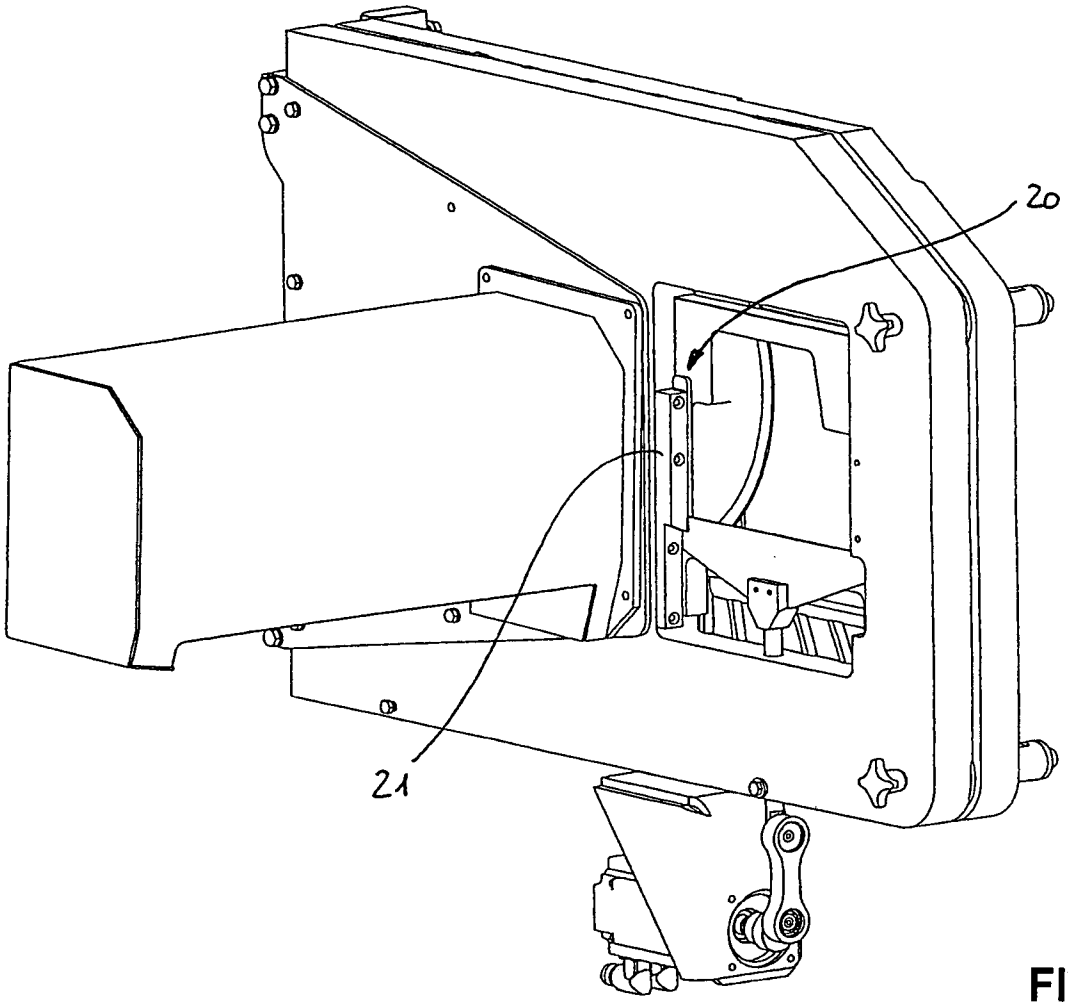
Figure 11:
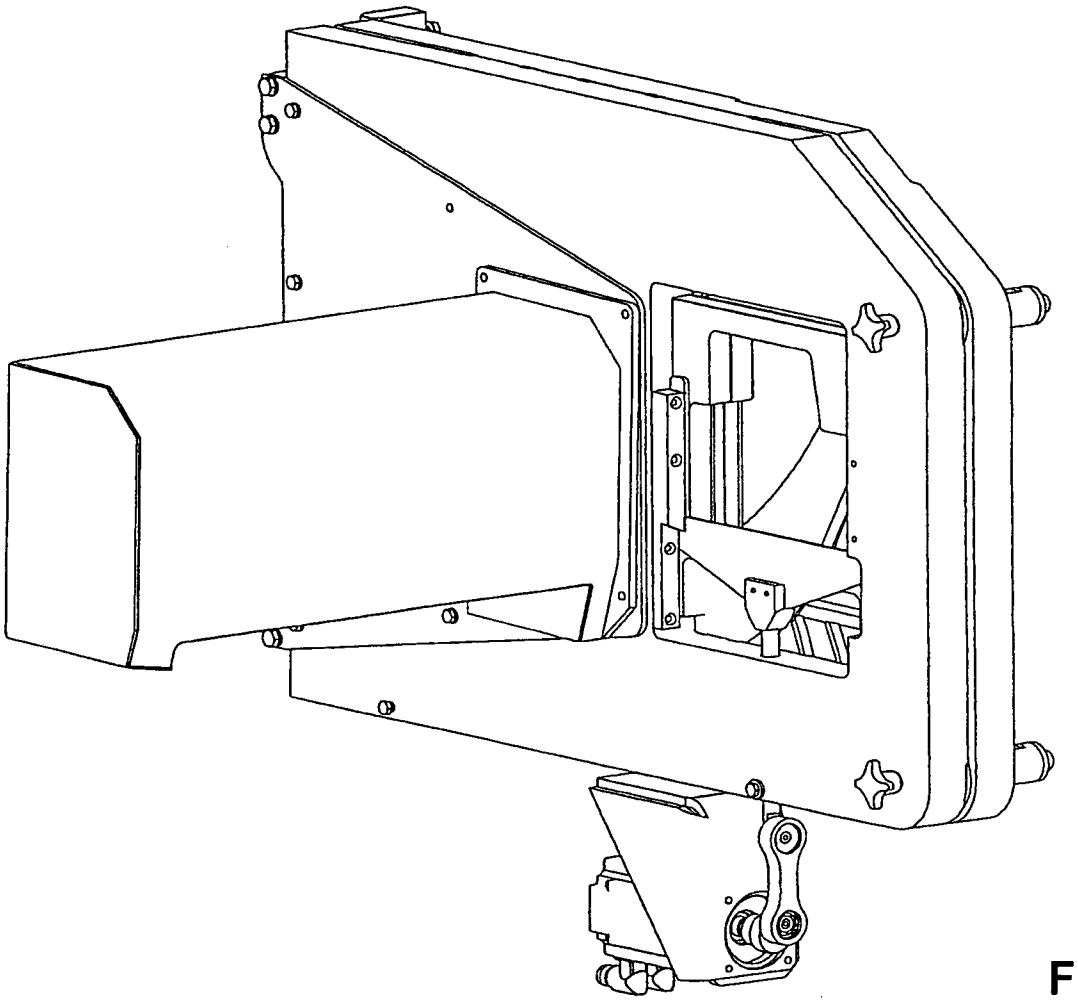
Figure 12:
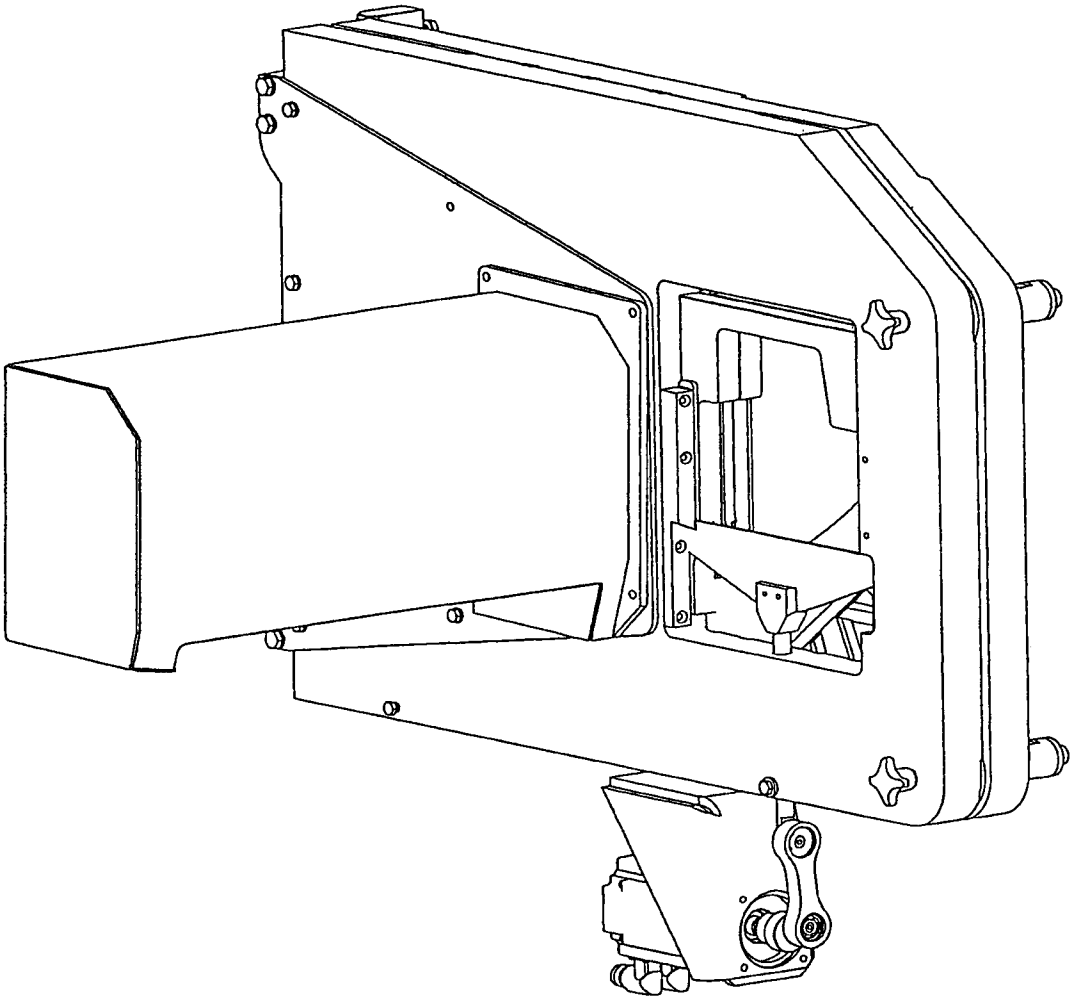
Figure 13:
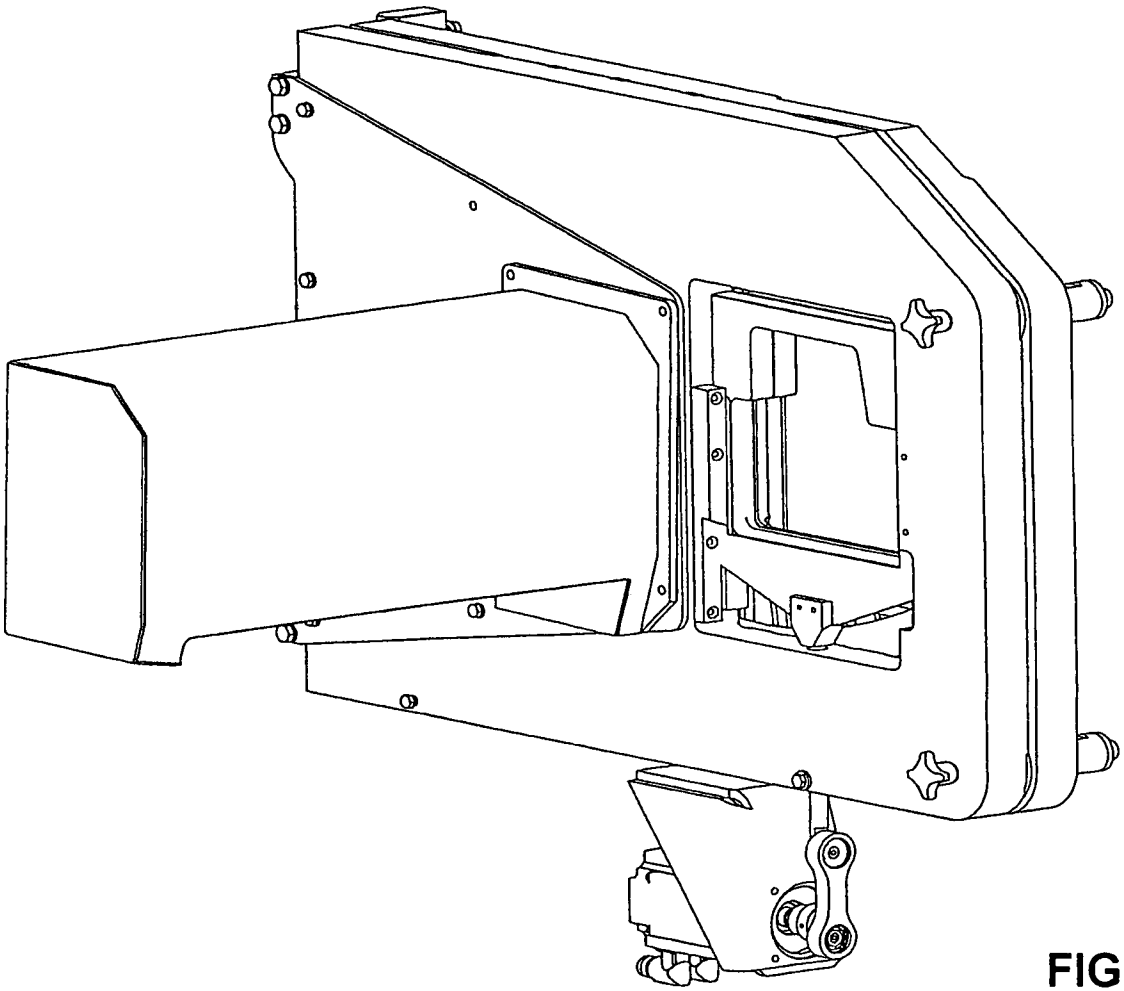

The brake element 15 is lowered further until it reaches its resting position 17 again (FIGS. 6 and 7) and the slice 3 has eventually flipped onto the conveying device 9 completely (FIG. 7). The cutting tool 7 is not visible in FIGS. 5-7, since it is disposed completely within the cutting frame 10.

While the transfer of the brake element 15 from its idle position 17 into its brake position 18 can be performed slowly, the transfer of the brake element 15 from its brake position 18 into its resting position 17 has to be performed quickly in order not to impede the flipping of the slice 3. In order to further facilitate the flipping of the slice 3, a lower surface of the cutting frame 10 forming a contact portion for the material string 2 can be configured slanted, so that it is oriented away from the material string 2 and oriented towards the conveying device 9.

FIGS. 8-13 illustrate the device 1 in plural stages of a cutting process, wherein an illustration of the feeding device 4 and of the conveying device 9 was omitted, so that the brake device 14 is visible more clearly. As already described supra, the brake element 15 is configured as a U-shaped slide 19 and includes a base arm 24 besides the two U-arms 20, wherein the base arm is approximately triangular, wherein a tip of the triangle is disposed on a side facing away from the conveying cross section 13.

FIGS. 8-13 illustrate that a base arm 24 of the brake element 15 is connected to the coupling element 22 through a coupling rod 25.

FIGS. 9-12 illustrate the U-arms 20 respectively protruding by different amounts beyond the support elements 21.

REFERENCE NUMERALS AND DESIGNATIONS

1 device
2 material string
3 slice
4 feed device
5 cutting device
6 contact surface
7 cutting tool
8 feed direction
9 conveying device
10 cutting frame
10' cutting frame
11 cutting box
12 pass-through opening
13 conveying cross section
14 brake device
15 brake element
16 crank drive
17 idle position
18 brake position
19 slide
20 U-arm
21 support element
22 coupling element
23 crank
24 base arm
25 coupling rod
uT bottom dead center
oT top dead center
a distance

What is claimed is:

1. A method for cutting a bone containing material string into slices, the method comprising the following steps:

feeding a bone containing material string through a feed device in a feed direction towards to a cutting device;

cutting a slice partially from an end of the bone containing material string through a rotating cutting tool of the cutting device;

moving a brake element of a brake device into a conveying cross section located in feed direction behind a cutting plane of the cutting tool before completely cutting the slice from the bone containing material string;

braking the slice after the slice has been completely cut from the remaining bone containing material string with respect to a movement of the slice oriented away from the cutting plane through the brake element;

and moving the brake element out of the conveying cross section after braking the slice and having the braked slice flip onto the conveying device; and placing the cutoff slices successively in a scaled or stacked arrangement onto a conveying device and conveying the cutoff slices from the cutting device.

2. The method according to claim 1, wherein the brake element is transferred from an idle position in which the brake element is disposed completely outside of the conveying cross section, into a brake position in which the brake element blocks a portion of the conveying cross section oriented towards a contact surface of the material string, and the brake element is subsequently transferred back into the idle position.

3. The method according to claim 2, wherein the brake element is moved between the idle position and the brake position in a plane which is aligned parallel to the cutting plane.

4. The method according to claim 2, wherein the brake element is disposed in the brake position at a distance viewed in feed direction from a face of a slice being created and still connected to the material string, wherein the face is oriented towards the brake element.

5. The method according to claim 1, wherein a rotation drive of the brake device is moved with different angular velocities viewed over a movement cycle of the brake element.

6. The method of claim 5, wherein the brake element is moved with a greater velocity from the brake position into the idle position than in the opposite direction.

7. A device for cutting a bone including material string into slices, the device comprising:

a cutting device including a rotating cutting tool, which defines a cutting plane;

a feed device, through which a bone including material string is movable towards the cutting device, so that successive slices are cutable from an end of the bone including material string;

a conveying device on which the cutoff slices are placeable successively in a scaled or stacked arrangement, and through which the slices are conveyable from the cutting device; and a brake device with a brake element which is movable from an idle position in which the brake element is disposed outside of a conveying cross section, into a brake position in which the slice cut off from the material string is brakeable in its movement oriented away from the cutting plane, wherein the brake element disposed in the idle position facilitates a flipping of the cutoff and braked slice onto the feed device.

8. The device according to claim 7, wherein the brake element is a slide, which is movable in a linear oscillating manner in a slide plane extending parallel to the cutting plane, and wherein two U-arms are movable on both sides of the feed cross section which is to defined by a pass-through opening in a cutting frame of the cutting device between the cutting frame and one respective support element.

9. The device according to claim 8, wherein the brake element has U-shape.

10. The device according to claim 7, further comprising a crank drive of the brake device, wherein the brake element is connected with a coupling element and the coupling element is connected with a crank that is drivable in rotation.

11. The device according to claim 7, wherein the brake element is disposed in the idle position below a plane defined by a contact surface of the feed device or of the conveying device.

12. The device according to claim 7, wherein a lower surface of the cutting frame arranged between the brake element disposed in the idle position and the cutting plane is slanted, wherein a surface orthogonal of the slanted surface is oriented away from the cutting plane.

* * * * *